US007681990B2

(12) United States Patent
Matsumoto

(10) Patent No.: US 7,681,990 B2
(45) Date of Patent: Mar. 23, 2010

(54) LIQUID JETTING APPARATUS AND METHOD FOR SWITCHABLY DRIVING HEATERS

(75) Inventor: Mitsuhiro Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 11/724,297

(22) Filed: Mar. 15, 2007

(65) Prior Publication Data

US 2007/0229568 A1 Oct. 4, 2007

(30) Foreign Application Priority Data

Mar. 17, 2006 (JP) ..... 2006-074526

(51) Int. Cl.
*B41J 2/05* (2006.01)

(52) U.S. Cl. ..... 347/56; 347/48; 347/57; 347/62

(58) Field of Classification Search ..... 347/20, 347/56–59, 61–65, 67, 48
See application file for complete search history.

(56) References Cited

U.S. PATENT DOCUMENTS 4,965,594 A * 10/1990 Komuro ..... 347/62
2005/0140732 A1 6/2005 Oikawa et al.

* cited by examiner

*Primary Examiner*—Juanita D Stephens
(74) *Attorney, Agent, or Firm*—Fitzpatrick Cella Harper & Scinto

(57) ABSTRACT

A liquid ejecting apparatus includes an element substrate having thereon a plurality of heaters for generating energy for ejecting liquid; a plurality of liquid chambers provided on the element substrate and having ejection outlets for ejecting the liquid, wherein a plurality of the heaters are disposed in each of the liquid chambers, and wherein one part of the heaters and the other part of the heaters are switchably operable; and a switching unit for switching between a mode in which the one part of the heaters is actuated as main heaters, and the other part of the heaters stands by as stand-by heaters, and a mode in which the other part of the heaters is actuated as main heaters, and the one part of heaters stands by as stand-by heaters. A center of gravity of the one part of heaters and a center of gravity of the other part of heaters are aligned with each other in a plane of the element substrate, and surfaces of the heaters are protected by an anti-cavitation film comprising metal.

13 Claims, 7 Drawing Sheets

FIG. 5(a)
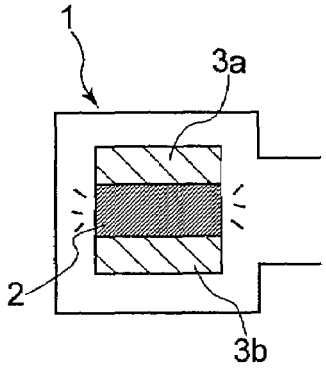
FIG. 5(b)
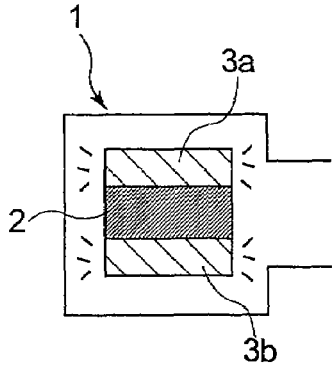
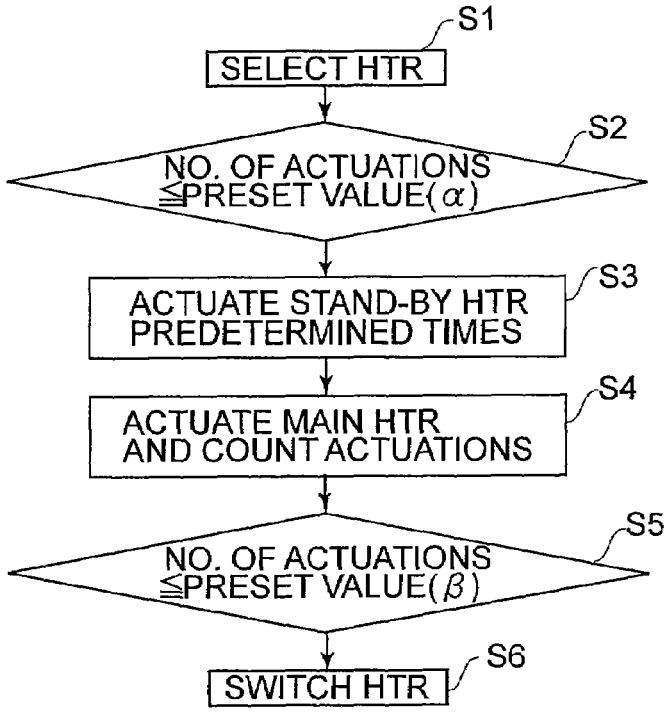
FIG.6

LIQUID JETTING APPARATUS AND METHOD FOR SWITCHABLY DRIVING HEATERS

FIELD OF THE INVENTION AND RELATED ART

The present invention relates to liquid jetting technologies for jetting liquid droplets toward recording medium, by utilizing the phenomenon that as thermal energy is given to a body of liquid in a liquid chamber (bubble generation chamber), bubbles are generated in the body of liquid.

Typical liquid jetting methods (ink jet recording methods) may be roughly classified into two categories: a category in which an electrothermal transducer element, such as a heater, is used, and a category in which a piezoelectric element is used. From the standpoint of reducing the size of a recording head, an ink jetting method which uses an electrothermal transducer element is superior to an ink jetting method which uses a piezoelectric element, because an electrothermal transducer element takes up less space, making it easier to place a large number of liquid jetting nozzles in an extremely small space, than a piezoelectric element. On the other hand, a liquid ejecting method which uses an electrothermal transducer element has a problem which is peculiar to this method, more specifically, the adverse effects which the cavitation, which occurs when a bubble collapses, has on an electrothermal transducer element, the adhesion of baked or scorched ink residues to the outer surface of the heater protection film, etc. These problems are likely to lead to the formation of an inferior image; they are liable to reduce the performance of an ink jet recording head in terms of print quality.

As the countermeasure for the adverse effects of the cavitation which occurs when a bubble collapses, and/or in order to protect a heater from the body of ink which will have been heated to an extremely high temperature, a heater is provided with cavitation-resistant film for protecting the heater. As the material for the cavitation-resistant film, a metallic substance such as Ta (tantalum) has been used. From the standpoint of making a heater more durable, however, ordinary metals (which include precious metals), and alloys thereof, which are greater in mechanical strength than Ta have been studied as the material for the cavitation-resistant film (U.S. Patent Application Publication No. 2005/0140732).

However, these substances have the following problems. That is, when one of the abovementioned substances which are greater in mechanical strength, and are less likely to chemically react with ink, than Ta, or the conventional material for the cavitation-resistance film, is used as the material for the cavitation-resistant film, the cavitation-resistant film is unlikely to be significantly shaved when a bubble collapses. Therefore, the ink residues, such as the scorched organic or inorganic ink ingredients, are liable to accumulate on the cavitation-resistant film. The accumulation of these deposits eventually causes a heater to generate unsatisfactory bubbles. Thus, the ink jet recording head suffers from the problem that it gradually becomes inferior in image quality with the increase in the cumulative number of times it jets ink. This is the problem suffered by a liquid jetting head (ink jet recording head) which uses an electrothermal transducer element.

SUMMARY OF THE INVENTION

From the standpoint of extending the service life of a heater by providing a heater with the cavitation-resistant film, the cavitation-resistant film is desired to be greater in mechanical strength and less chemically reactive. Providing a heater with a cavitation-resistant film which is greater in mechanical strength and less chemically reactive reduces the effects of the impacts from the cavitation, upon a heater, and also, improves the heater in ink resistance. On the other hand, the strengthening of a cavitation-resistance film makes it less likely for the cavitation-resistance film to be shaved, and therefore, is likely to allow scorched ink ingredients to accumulate on a heater (cavitation-resistant film). In other words, the strengthening of the cavitation-resistant film is liable to gradually cause a heater to generate unsatisfactory bubbles. In other words, replacing the conventional material for a cavitation-resistant film with a material which is greater in mechanical strength and less chemically reactive, has a tradeoff.

The present invention was made in consideration of the above described problems. Thus, the primary object of the present invention is to provide an ink jet recording head whose cavitation-resistant film is formed of a substance which is different from the conventional material for the cavitation-resistance film, and onto which the scorched ink ingredients or the like are liable to accumulate, and which yet is unlikely to suffer from the problems associated with the accumulation of scorched ink ingredients or the like on the cavitation-resistant film, and therefore, is superior in longevity in terms of the bubble generation performance of its heaters, to an ink jet recording head whose cavitation-resistant film is formed of the conventional material, and also, to provide a recording apparatus compatible with such an ink jet recording head.

According to an aspect of the present invention, there is provided a liquid ejecting apparatus comprising an element substrate having thereon a plurality of heaters for generating energy for ejecting liquid; a plurality of liquid chambers provided on said element substrate and having ejection outlets for ejecting the liquid, wherein a plurality of said heaters are disposed in each of said liquid chambers, and wherein one part of said heaters and the other part of said heaters are switchably operable; and switching means for switching between a mode in which said one part of said heaters are actuated as main heaters, and said other part of heaters stand by as stand-by heaters, and a mode in which said other part of said heaters are actuated as main heaters, and said one part of heaters stand by as stand-by heaters;

wherein a center of gravity of said one part of heaters and a center of gravity of said other part of heaters are aligned with each other in a plane of said element substrate, and wherein surfaces of said heaters are protected by anti-cavitation film comprising metal.

According to an embodiment of the present invention, each of the multiple heaters of a liquid jetting head (ink jet recording head) is made up of multiple small heaters, and the small heaters are organized into two groups: a primary group and a standby group. In operation, the primary and standby groups are made to alternately operate in the first and second mode to prevent scorched ink ingredients or the like from accumulating on the heater. Therefore, the present invention improves the heaters of a liquid jetting head (ink jet recording head) in durability.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIGS. 5(*a*) and 5(*b*) are schematic drawings of one of the heaters, showing the switching of the main heater.

FIG. 6 is a flowchart of the second example of the sequence for driving a heater.

DETAILED DESCRIPTION OF THE PREFERRED EMBODIMENTS

Hereinafter, one of the preferred embodiments of the present invention will be described in detail with reference to the appended drawings.

[Structure of Liquid Jetting Head]

Figure 1A:
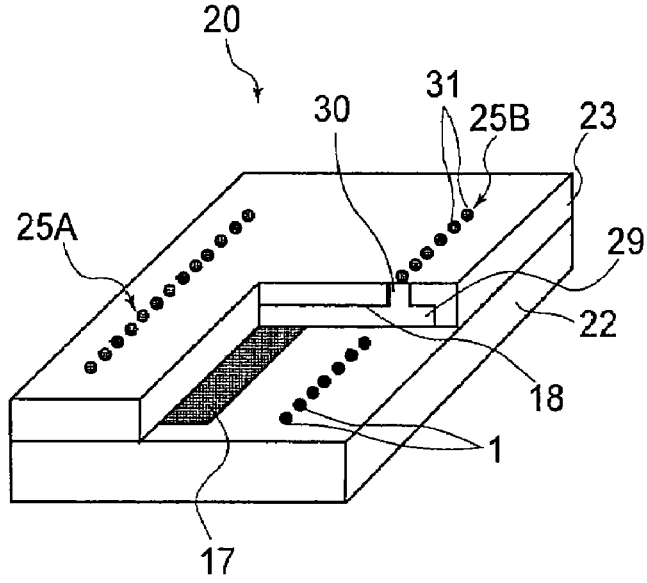
FIGS. 1(*a*) and 1(*b*) are perspective and top views, respectively, of the liquid jetting head in accordance with the present invention, in one of the preferred embodiments of the present invention.
Figure 1B:
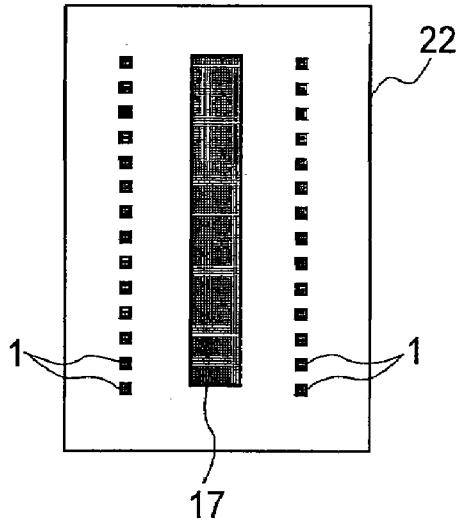

FIG. 1 shows one of the liquid jetting heads (ink jet recording heads) in accordance with the present invention. FIG. 1(*a*) is a perspective view of the liquid jetting head, and FIG. 1(*b*) is a top view of the liquid jetting head.

The liquid jetting head 20 is made up of a substrate 22, multiple heaters 1, and an orifice plate 23 (orifice substrate). The heaters 1 are on the primary surface (top surface in drawing) of the substrate 22. The orifice plate 22 is a member which is attached to the primary surface of the substrate 22 to form the liquid passages of the liquid jetting head 20.

Each heater 1 is an electrothermal transducer element, for example. It is a heat generating resistor, which generates heat as voltage is applied thereto in response to a driving signal. Referring to FIG. 1(*b*), the substrate 22 is provided with a common ink delivery chamber 17, which is a through hole located in the center of the substrate 22, and is long and narrow in cross section. The abovementioned heaters 1 are arranged in two straight parallel rows, which sandwich the common liquid delivery chamber 17.

The orifice plate 23 is a structural member which provides the liquid jetting head 20 with multiple ink jetting holes 31 (ink jetting nozzles), and multiple ink delivery passages 18 for delivering ink from the common ink delivery chamber 17 to the multiple ink jetting holes 31, one for one. The ink jetting holes 31 face the heaters 1, one for one. The outward opening of each nozzle 31 coincides with the outward surface of the orifice plate 23. Thus, the top surface of the orifice plate 23 has two straight rows, that is, first and second rows 25A and 25B, of the openings of the nozzles, which are in parallel to each other.

The pitch of the exit openings of each row of nozzles is in a range of 600 opening/inch-1,200 opening/inch. The two rows 25A and 25B of nozzles are offset in their lengthwise direction so that the exit openings of the first row of nozzles are staggered by half the exit opening pitch, relative to the corresponding exit openings of the second row of nozzles.

Figure 2A:
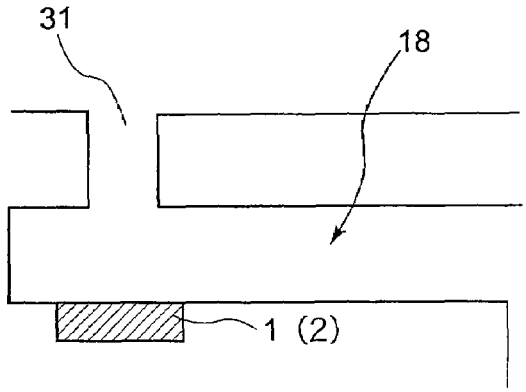
FIGS. 2(*a*) and 2(*b*) are enlarged sectional and plan views, respectively, of one of the ink delivery passages, and its adjacencies, of the liquid jetting head shown in FIG. 1.
Figure 2B:
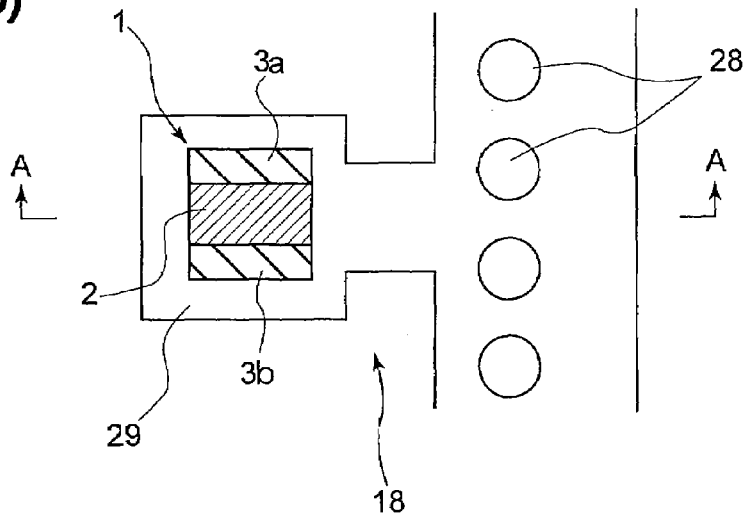

FIGS. 2(*a*) and 2(*b*) are enlarged view of one of the ink delivery passages, and its adjacencies, showing the structures thereof. Referring to FIG. 2(*b*), the forward end (left side in drawing) of each ink delivery passage, in terms of the ink delivery direction, is connected to a liquid chamber 29 (bubble generation chamber), to which the corresponding ink jetting hole 23 is connected. The liquid jetting head shown in FIG. 2 is provided with multiple columnar nozzle filters, which are in the common ink delivery chamber 17 to prevent foreign debris from entering the ink delivery passages 18. This structural arrangement is not intended to limit the present invention in scope.

The heater 1 in each liquid chamber 29 is made up of multiple smaller heaters 2, 3*a*, and 3*b* (which hereafter will be referred to as heater 2, 3*a*, and 3*b*). In this embodiment, the heaters 2, 3*a*, and 3*b* are arranged so that the heater 2 (which hereafter may also be referred to as first heater 2) is sandwiched by the heaters 3*a* and 3*b* (which hereafter may be collectively referred to as second heaters 3). The heaters 2, 3*a*, and 3*b* are independently drivable.

Figure 3:
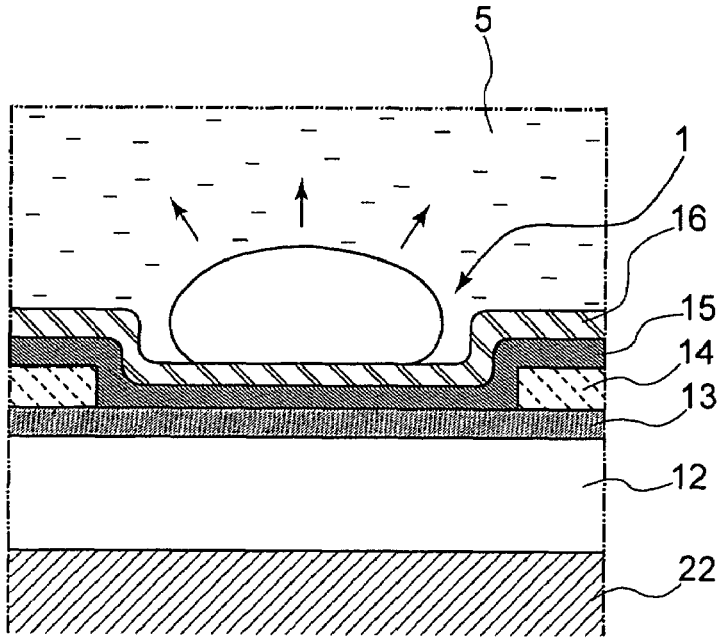
FIG. 3 is an enlarged sectional view of one of the heaters, and its adjacencies, of the liquid jetting head shown in FIG. 1, showing the details thereof.

Next, referring to FIG. 3, which is a sectional view of the heater 1, the structure of the heater 1 will be concretely described. The heater 1 is provided with a heat storage layer and an electrically insulative layer 12, which are layered on the top surface of the substrate 22. It is also provided with a heater layer 13, an electrical wiring portions 14, an electrically insulative layer 15, and a cavitation-resistant film 16, which are layered on the electrically insulative layer 12 in the listed order. The cavitation-resistant film 16 covers the areas of the electrically insulative layer 15, which would have been in contact with liquid (ink) if it were not for the cavitation-resistant film 16. This film 16 is provided to prevent the laminar structure under the film 16 from being damaged.

As electrical voltage is applied to the electrical wiring portion 14, the heater layer 13 of the heater 1 generates heat. This heat generates a bubble (bubbles); it causes a part of the body of liquid in the bubble generation chamber 29 to instantly boil (change in phase from liquid to gas), abruptly increasing the internal pressure of the bubble generation chamber 29. As a result, a part of the body of liquid (ink) in the bubble generation chamber 29 is abruptly pushed out (jetted out) through the liquid jetting hole 31.

As the materials for the heat storage layer and electrically insulative layer 12, silicon oxide is used. As the material for the heater layer 13, one of such electrically resistant substances as TaSiN or TaN, that generate heat as voltage is applied thereto (electrically resistant heat generating substances) is used. As the material for the electrically insulative layer 14, SiN is used. As the material for the electrical wiring 15, aluminum is used. When the material for the cavitation-resistant film 16 is an ordinary metal such as Ta, a precious metal such as Ir and Pr, or an alloy (IrRe or the like) which contains the preceding metal or metals, scorched ink ingredients or the like are liable to accumulate on the cavitation-resistant film 16. Thus, this accumulation of scorched ink ingredients or the like is removed utilizing the reaction from the bubble generation which occurs as a heater 1 is driven.

[Liquid Jetting Apparatus]

Figure 9:
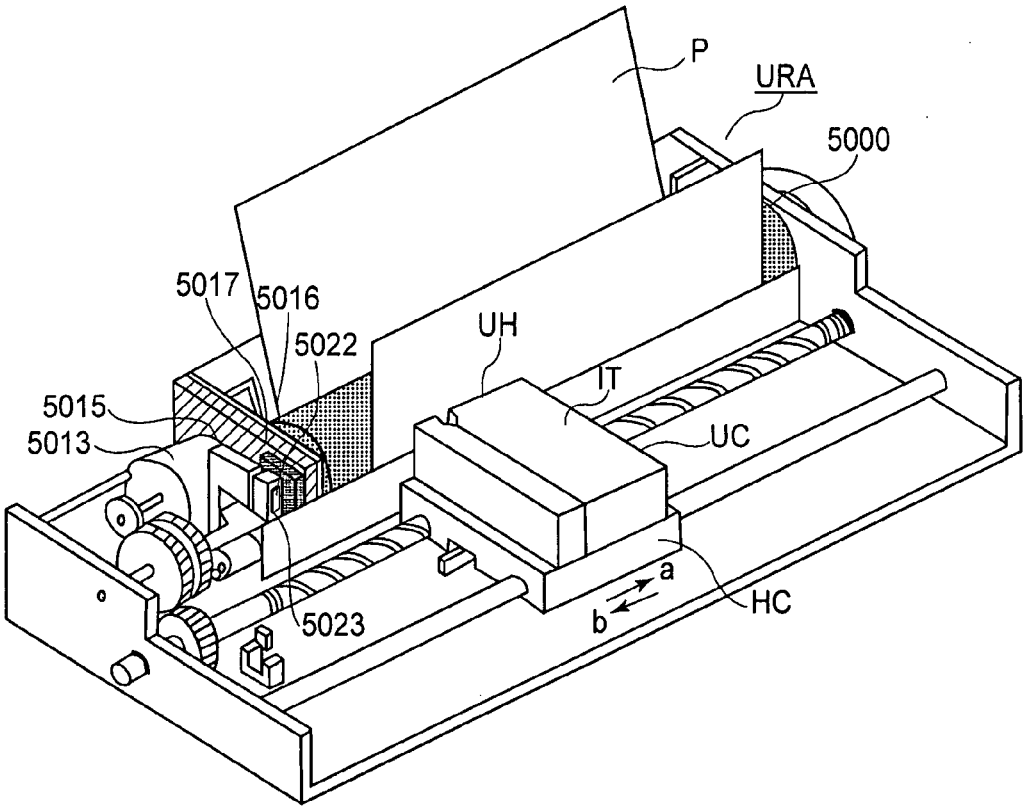
FIG. 9 is an external perspective view of a typical liquid jetting apparatus which is in accordance with the present invention.

FIG. 9 is an external view of a typical liquid jetting apparatus (ink jet recording apparatus) in one of the preferred embodiments of the present invention, and shows the general structure of the apparatus. The carriage HC, which is holding an ink jet cartridge IJC is reciprocally driven, that is, in the direction indicated by an arrow marks a or b, by a carriage motor 5013. The ink jet cartridge IJC is provided with an ink container IT which holds the liquid to be jetted out of a liquid jetting head IJH (which hereafter may be referred to as head). A platen 5000 supports recording paper P (recording medium) as the recording paper P is conveyed. Designated by a referential number 5015 is a suctioning means for suctioning liquid (ink) through a capping member 5022 which covers the front surface of the ink jet cartridge IJC. The suctioning means 5015 is for restoring the liquid jetting head in performance by suctioning ink through the opening 5023 of the capping member 5022. Designated by a referential number 5017 is a cleaning blade. The liquid jetting apparatus is also provided with a driver for sending driving signals to each heater, a counting apparatus for counting the number of times liquid is jetted, etc.

Next, two examples of the sequence for driving the liquid jetting head, in this embodiment, the structure of which is as described above, will be described.

[First Example of Sequence for Driving Liquid Jetting Head]

Figure 4:
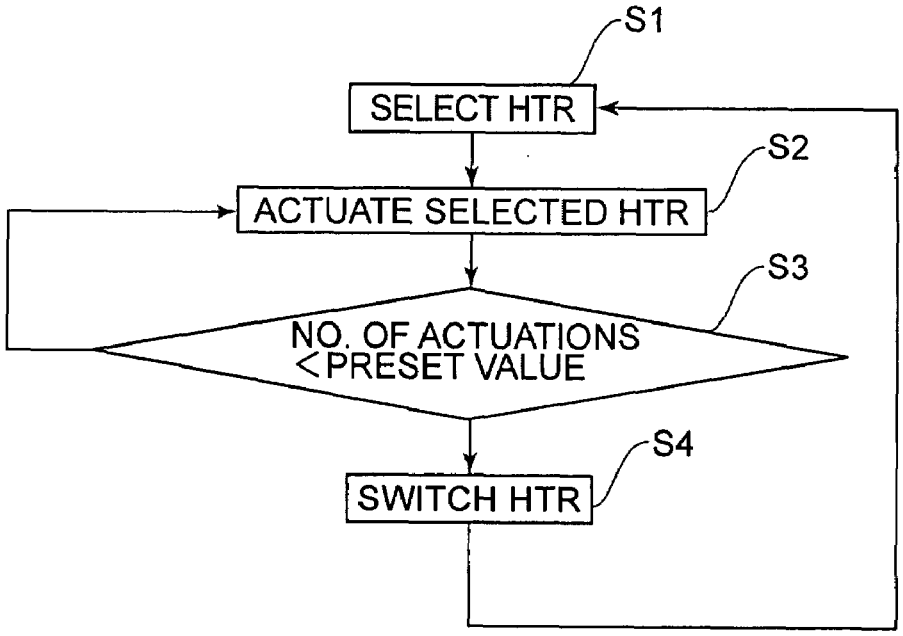
FIG. 4 is a flowchart of the first example of the sequence for driving a heater.

Next, referring to FIG. 4, the first example of the sequence for driving the liquid jetting head 20 shown in FIG. 2 will be described.

Each of the multiple heaters 1 of the liquid jetting head is made up of the first heater 2 and second heaters 3 (3*a* and 3*b*), as described above. The first step in the heater driving sequence is to decide which of the heaters 2, 3*a*, and 3*b* are to be used for jetting liquid (Step 1). For example, it is possible to select the first heater 2, as the main heater (heater used for jetting liquid), and the second heaters 3 (3*a* and 3*b*), as the standby heaters (Step S2), as shown in FIG. 5. In this case, an ink droplet (droplets) is ejected from the liquid jetting hole 31 by driving the first heater 2 (first operational mode). The number of times the first heater 2 was driven is counted by a counting apparatus which is provided as a part of a controlling apparatus.

The first heater 2 is used until the number of times the first heater 2 was driven reaches a value set in advance (preset value) (Step S3). As the preset value is reached, the driving of the first heater 2 is stopped to switch the main heater. That is, from this point on, the second heaters 3 (3*a* and 3*b*) are used as the main heaters, and the first heater 2 is used as the standby heater (FIG. 5(*b*)). Thus, from this point on, an ink droplet (droplets) is jetted through the liquid jetting hole 31 by the driving of the second heaters 3 (3*a* and 3*b*) (second operational mode). The number of times the second heaters 3 (3*a* and 3*b*) were driven is also counted by the abovementioned counting apparatus.

The abovementioned "preset value" is desired to be such a value that is not large enough for the deposits, which will have accumulated on the surface of the heater, to affect the jetting of liquid. For example, it is desired to be no less than $1\times10^5$ and no more than $1\times10^8$. The number of times the second heaters are to be driven is also set to a specific value in advance, and as this value is reached, the role of the main heater is switched back to the first heater. Incidentally, the value to be preset for transferring the role of the main heater from the first heater to the second heaters, and the value to be preset for transferring the role of the main heater from the second heaters to the first heater, do not need to be the same; they may be the same or different.

While the first heater 2 is driven for the second time, the deposits (scorched ink ingredients) having adhered to the surface of the second heaters 3, and their adjacencies, are gradually removed by the cavitation which occurs as the first heater 2 is driven. In other words, as the first heater 2 is driven, the scorched ink ingredients on the second heaters 3 are removed, enabling the second heaters 3 to normally jet ink when they are driven for the second time. Similarly, while the second heaters 3 are driven, the scorched ink ingredients on the first heater are removed by the cavitation caused by the driving of the second heaters 3.

While any of the heaters is driven, the ink flow in the adjacencies of the driven heater behaves very violently, triggering thereby cavitation. The impact from the cavitation is substantial, in particular, when a bubble (bubbles) collapses. Thus, these impacts are utilized to gradually remove the scorched ink ingredients having adhered to the adjacent heaters.

In other words, in this embodiment, each heater 1 is made up of multiple smaller heaters, which are organized into two groups, which are alternately used (driven) as the main group, that is, the group which is used for jetting ink. Thus, while one group is driven as the main group, the deposits on the other group, or the standby group, is removed by the cavitation caused by the driving of the main group. Therefore, the amount by which the deposits remain on the heater is minimized. Therefore, this embodiment can prevent a liquid jetting head from falling in print quality, and also, can improve each heater in durability, making therefore a liquid jetting head last longer.

Further, the two groups of heaters are alternately driven in the first and second operational modes. Therefore, the scorched ink ingredients are removed from both groups of heaters. Therefore, the amount by which the scorched ink ingredients remain on the heaters is minimized.

[Example of Heater Arrangement]

The small heaters of the two heater groups of each of the compound heaters of the ink jet recording head are desired to be arranged on the surface of the substrate so that the overall centers of gravity of the main group of heaters and the standby group of heaters, coincide. In this embodiment, both the first heater 2 (one group of heaters) and the second heaters 3 (another group of heaters), between which switching is made, are involved in the jetting of ink. Therefore, they must be arranged in a pattern that can keep stable the direction in which liquid is jetted, regardless of the switching. As long as the two groups of heaters are arranged in such a pattern that the overall centers of gravity of the main and standby groups of heaters coincide, the direction in which liquid droplets are jetted remains constant, preventing thereby the liquid droplets from deviating in terms of their landing spots on recording paper, even if switching is made between the main and standby groups of heaters. Therefore, it is possible to provide a liquid jetting head (ink jet recording head) which can continuously print images of higher quality and higher resolution, and is more durable, than a liquid jetting apparatus in accordance with the prior art.

[Second Example of Sequence for Driving Liquid Jetting Head]

Referring to FIG. 6, the second example of driving sequence for the liquid jetting head 20 will be described. The components, component portions, etc., which will be mentioned in the following description of this example of driving sequence, and are identical to those in the first example, will not be described.

First, it is decided which group of heaters is used as the main group, as it was in the first sequence (Step S1). For example, the setup may be such that the first heater 2 shown in FIG. 5 is initially used as the main heater (one group), and the second heaters 3 (3*a* and 3*b*) are designated as the standby heaters (other group). Also in this case, the number of times the first heater 2 was driven is counted by the unshown counting apparatus, as it was in the first sequence.

The first heater 2 is continuously driven until the number of times the heater 2 was driven reaches a first preset value $\alpha$ (first operational mode). As soon as the preset value $\alpha$ is reached, the driving of the first heater 2 is stopped to transfer the role of the main heater. The "first preset value $\alpha$" is also such a value that is not large enough for the scorched ink ingredients, which will have accumulated on the surface of the heater 2 due to the driving of the heater 2, to affect the jetting of liquid. For example, it is in the range of no less than $1\times10^5$ and no more than $1\times10^8$ (Step S2).

Next, the second heaters 3 (3*a* and 3*b*) are driven in the third mode, that is, an operational mode in which the heater(s) is driven to remove the deposits without making an ink jet head to jet out liquid droplets (Step S3). More specifically, the standby heaters are driven for a preset number of times, by providing them with a voltage, the value of which is no less than 85%, and no more than 105%, of the threshold value for bubble generation, or such a pulse, the duration of which is no less than 72%, and no more than 110%, of the threshold value for the bubble generation.

Next, the abovementioned third operational mode will be described in more detail. The definition of the threshold energy value for bubble generation (threshold value for bubble generation) is the amount of energy necessary to be given to the liquid on a heater to cause the liquid to boil. Usually, it is a value large enough to increase the surface temperature of a heater to 300 degrees. The value of the smallest pulse capable of causing the liquid on a heater to boil is the threshold pulse value for bubble generation, and the minimum voltage necessary to be applied to a heater to cause the ink on the heater to boil is the threshold voltage value for bubble generation.

Generally, when the bubble generation energy is no less than 120% of the bubble generation energy threshold value, the liquid in contact with the surface of the heater continuously boils, creating thereby virtually vacuum space, which functions as thermally insulating between the heater surface and the body of ink thereon. Therefore, the amount by which the heat generated by the heater transmits to the ink reduces. When the bubble generation energy threshold value is no less than 72% and no more than 110%, the microscopic boiling of liquid develops into the full-blown boiling of liquid, and therefore, heat flux is largest when the bubble generation energy is in this range. Thus, when the bubble generation energy is in this range, the behavior of the body of liquid in the adjacencies of the surface of the heater is extremely violent, being therefore greatest in terms of the physical force which acts on the scorched ink ingredients having accumulated on the heater surface.

In other words, the preceding heater driving sequence can be enhanced in the scorched ink ingredient removing effect, by inserting a period, in which the standby heaters are driven by the bubble generation energy, the magnitude of which is no less than 72%, and no more than 110%, of the bubble generation energy threshold value, into the interval in which the role of the main heater is transferred from one group of heaters to the other. In this embodiment, the numerical value for the bubble generation energy range is preset in consideration of the film structure, the reduction in the thermal conductivity attributable to the adhesion of the scorched ink ingredients, and the like factors.

As for an example of "voltage, the value of which is no less than 85%, and no more than 105%, of the bubble generation threshold value," it is roughly 17 V-24 V when a heat storage layer formed of SiO is 2.6 μm; an electrically insulative layer formed of silicon nitride is 3,000 A in thickness; a cavitation-resistant film formed of tantalum is 2,300 A in thickness; the heater resistance is 3,500 Ω; the wiring resistance is 21 Ω; the heater size is 26 $\mu m^2$; and the heater driving pulse is 0.8 μs. An example of "pulse length which is no less than 72%, and no more than 110%, of the bubble generation threshold value" is roughly no less than 0.5 μs and no more than 1.4 μs, when the driving voltage is 18 V, and the heater structure is the same as the above described one.

Incidentally, the abovementioned "preset number of times" is desired to be no less than $1\times10^2$ and no more than $1\times10^5$.

In other words, in this second example of heater driving sequence, after the second heaters are driven in the third operation mode, in which they are driven the preset number of times by applying the preset voltage, as described above, the first heater 2 is driven again as the main heater (Step S4) (first operation mode). The number of times the heater 2 was driven is counted by the unshown counting apparatus, as described before.

This driving of the first heater 2 is continued until the number of times the first heater 2 was driven reaches a second preset value $\beta$. As soon as the value $\beta$ is reached, the heaters are switched. The "second preset value $\beta$" is also not large enough for the scorched ink ingredients, which will have adhered to the heater due to the driving of the heater, to affect the jetting of liquid (ink), as described above. For example, it is in a range of no less than $1\times10^5$ times and no more than $1\times10^8$ times.

Next, the second heaters 3 are driven as the main heater, as they were in the second mode. While the second heaters 3 are driven in this second mode, the first heater 2 is driven in the third mode, or the mode in which the heater is driven for removing the deposits, with the bubble generation energy kept in the range in which liquid droplets are not jetted.

In this second example of heater driving sequence, not only is the heater driven as the main heater is switched in operational mode between the first and second operational modes, but also the third operation mode, in which the standby heaters are driven with the use of a voltage, the magnitude of which is no less than 85%, and no more than 105%, of the bubble generation threshold voltage, or the pulse, the width of which is no less than 72%, and no more than 110%, of the bubble generation pulse width threshold value, is inserted between the first and second operational modes. Therefore, the second example of heater driving sequence is superior to the first example, in terms of the removal of the scorched ink ingredients on the heaters.

The third operational mode, that is, the operational mode in which the standby heater(s) is driven to such a degree that liquid is not jetted, may be carried out during at least one of the first and second operational modes, as described above. However, the third operational mode may be inserted into the period in which the switching is made between the first and second operational modes.

[Other Examples of Heater Arrangement]

Figure 7A:
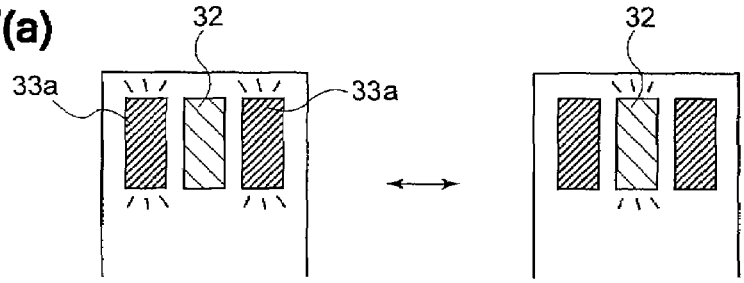
FIGS. 7(*a*)-7(*c*) are schematic drawings of examples of a heater arrangement.
Figure 7B:
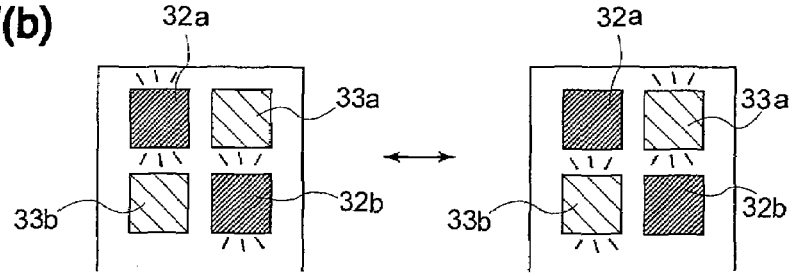
Figure 7C:
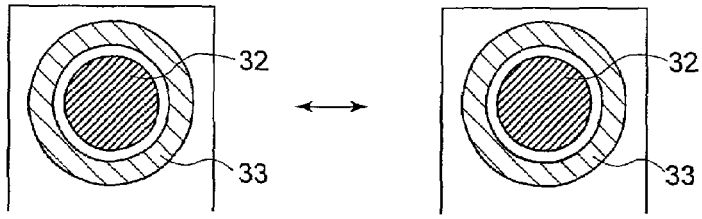

Described above was one of the preferred embodiments of the present invention. However, the present invention is not to be limited in scope by the above described embodiment, and is modifiable in various forms. For example, a gap may be provided between the first heater 32 and second heater 33*a*, and between the first heater 32 and second heater 33*b*, as shown in FIG. 7(*a*). Further, the first heaters and second heaters may be arranged in a matrix, as shown in FIG. 7(*b*). Also, the first and second heaters may be concentrically arranged as shown in FIG. 7(*c*).

Figure 8A:
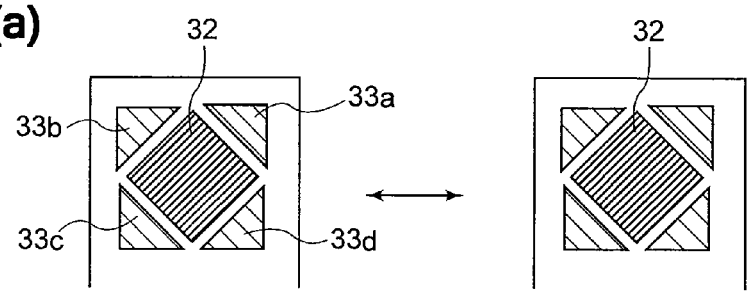
FIGS. 8(*a*)-8(*c*) are schematic drawings of additional examples of a heater arrangement.
Figure 8B:
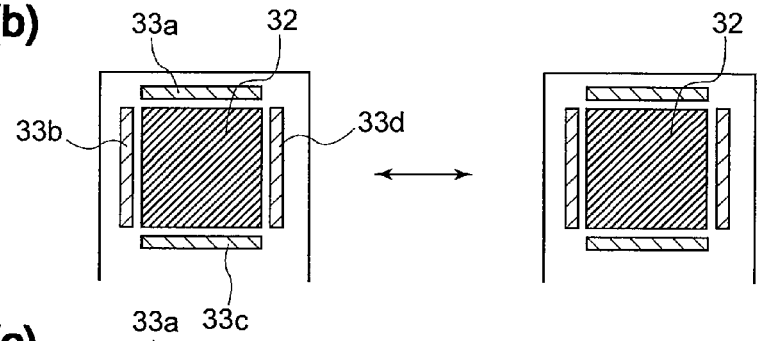
Figure 8C:
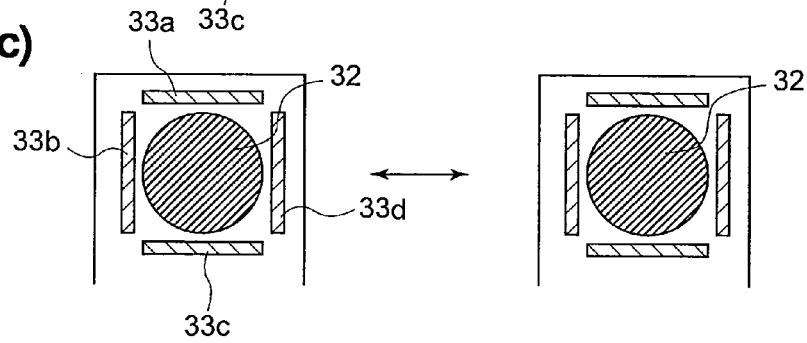

Moreover, referring to FIG. 8(*a*), each heater may be a combination of a first small heater 32 and four second small heaters 33*a*-33*d*, which are arranged so that the first small heater 32 is surrounded by the four second small heaters 33*a*-33*d*. Further, referring to FIG. 8(*b*), each heater may be a combination of a square first small heater 32 and four rectangular second small heaters 33*a*-33*d*, which are arranged in such a manner that the first heater 32 is surrounded by the four second heaters 33*a*-33*d*. Further, referring to FIG. 8(*c*), each heater may be a combination of a circular first small heater 32 and four rectangular second small heaters 33*a*-33*d*, which are arranged so that the first small heater 32 is surrounded by the four second small heaters 33*a*-33*d*.

The feature which is essential and common to the heater structures shown in FIGS. 7 and 8 is that an ink jet recording head is structured so that an ink droplet which is jetted when the first small heater 32 is driven as the main heat generator, and an ink droplet which is jetted when the second small heaters 33 are driven as the main heat generators, are the same in size. As for the means for realizing such an ink jet recording head, it is desired that the both the first and second small heaters are symmetrically arranged, or the total amount of energy which the first small heaters output together is the same as the total amount of energy which the second small heaters output together.

In any of the above described cases in which each of the multiple heaters is made up of multiple small heaters, it is desired, from the standpoint of satisfactorily jetting liquid (ink), that the overall center of gravity of the small heater group, which is used as the main heat generator, and the overall center of the small heater group, which is used as the standby heat generator, coincide.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 074526/2006 filed Mar. 17, 2006 which is hereby incorporated by reference herein.

What is claimed is:

1. A liquid ejecting apparatus comprising:

an element substrate including a member for constituting a liquid chamber for storing liquid, wherein the liquid chamber is in fluid communication with ejection outlets for ejecting liquid;

a plurality of heaters, provided on said element substrate, for generating energy for ejecting the liquid through the ejection outlets, wherein, for each of the ejection outlets, one part of said heaters and another part of said heaters are switchably operable; and switching means for switching between a first mode in which the one part of said heaters is actuated as main heaters, and the other part of said heaters stands by as stand-by heaters, and a second mode in which the other part of said heaters is actuated as main heaters, and the one part of said heaters stands by as stand-by heaters, wherein the one part of said heaters and the other part of said heaters are disposed so as not to overlap with each other with respect to a direction perpendicular to a surface of said element substrate, and a center of gravity of the one part of said heaters and a center of gravity of the other part of said heaters are aligned with each other in a plane of said element substrate, and wherein surfaces of said heaters are protected by an anti-cavitation film comprising metal.

2. An apparatus according to claim 1, wherein the metal is a noble metal.

3. An apparatus according to claim 1, wherein the metal is an alloyed metal.

4. An apparatus according to claim 1, wherein said switching means operates to switch from the first mode to the second mode upon reaching a predetermined number of actuations of the main heaters in the first mode.

5. An apparatus according to claim 1, wherein said apparatus is operable in a third mode in which the stand-by heaters are actuated to an extent insufficient to eject the liquid in a period during actuation in the first mode or the second mode.

6. An apparatus according to claim 1, wherein said apparatus is operable in a third mode in which the stand-by heaters are supplied with a voltage not less than 85% and not more than 105% of an ejecting bubble generation threshold voltage.

7. An apparatus according to claim 1, wherein said apparatus is operable in a third mode wherein the stand-by heaters are supplied with a pulse voltage with such pulse intervals not less than 72% and not more than 110% of a threshold of an ejection bubble generation period.

8. An apparatus according to claim 1, wherein the anti-cavitation film comprises Ta, Ir or Pt or an alloy of two or more of Ta, Ir and Pt.

9. An apparatus according to claim 1, wherein said switching means switches between the first mode and the second mode when a number of actuations of the one part of said heaters or the other part of said heaters acutated as main heaters reaches a predetermined number.

10. An apparatus according to claim 1, wherein the liquid ejected in the first mode and the liquid ejected in the second mode have substantially the same volume.

11. A liquid ejecting method comprising:

preparing a liquid ejecting head including an element substrate including a member for constituting a liquid chamber for storing liquid, wherein the liquid chamber is in fluid communication with ejection outlets for ejecting liquid, a plurality of heaters, provided on the element substrate, for generating energy for ejecting the liquid through the ejection outlets, wherein, for each of the ejection outlets, one part of the heaters and another part of the heaters are switchably operable, the one part of the heaters and the other part of the heaters are disposed so as not to overlap with each other with respect to a direction perpendicular to a surface of the element substrate, and a center of gravity of the one part of the heaters and a center of gravity of the other part of the heaters are aligned with each other in a plane of the element substrate, and surfaces of the heaters are protected by anti-cavitation film comprising metal; and actuating the heaters selectively in a first mode in which the one part of the heaters is actuated as main heaters, and the other part of the heaters stand by as stand-by heaters, and a second mode in which the other part of the heaters are actuated as main heaters, and the one part of the heaters stand by as stand-by heaters.

12. A method according to claim 11, wherein the metal is a noble metal.

13. A method according to claim 11, wherein the metal is an alloyed metal.

* * * * *